US008783831B2

(12) United States Patent
Mardilovich et al.

(10) Patent No.: US 8,783,831 B2
(45) Date of Patent: Jul. 22, 2014

(54) FLUID EJECTION DEVICE HAVING FIRING CHAMBER WITH CONTOURED FLOOR

(75) Inventors: Peter Mardilovich, Corvallis, OR (US); Lawrence H. White, Corvallis, OR (US); Erik D. Torniainen, Maple Grove, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/977,104

(22) PCT Filed: Jan. 30, 2012

(86) PCT No.: PCT/US2012/023081

§ 371 (c)(1),
(2), (4) Date: Jun. 28, 2013

(87) PCT Pub. No.: WO2012/106230

PCT Pub. Date: Aug. 9, 2012

(65) Prior Publication Data

US 2013/0286102 A1 Oct. 31, 2013

Related U.S. Application Data

(63) Continuation-in-part of application No. PCT/US2011/023224, filed on Jan. 31, 2011, and a continuation-in-part of application No. PCT/US2011/026732, filed on Mar. 1, 2011.

(51) Int. Cl.
*B41J 2/14* (2006.01)

(52) U.S. Cl.
USPC ..... 347/54

(58) Field of Classification Search
USPC ..... 347/54, 63
See application file for complete search history.

(56) References Cited

U.S. PATENT DOCUMENTS

| | | | | |
|---|---|---|---|---|
| 6,378,984 | B1 | 4/2002 | Steinfiled et al. | |
| 6,502,918 | B1 | 1/2003 | Seaver et al. | |
| 6,926,389 | B2 | 8/2005 | Lee et al. | |
| 7,207,661 | B2 | 4/2007 | Chou et al. | |
| 7,210,766 | B2 | 5/2007 | Kuk et al. | |
| 7,475,966 | B2 | 1/2009 | Fujii et al. | |
| 7,506,962 | B2 | 3/2009 | Murakami et al. | |
| 7,533,968 | B2 | 5/2009 | Silverbrook | |
| 7,905,580 | B2 | 3/2011 | Xu et al. | |
| 8,210,654 | B2 * | 7/2012 | Wei et al. | 347/55 |
| 2003/0063163 | A1 | 4/2003 | Seaver et al. | |
| 2003/0081076 | A1 | 5/2003 | Park et al. | |
| 2003/0117461 | A1 | 6/2003 | Park et al. | |
| 2005/0280670 | A1 | 12/2005 | Chuang et al. | |
| 2006/0038855 | A1 | 2/2006 | Kim et al. | |
| 2009/0009562 | A1 | 1/2009 | Park et al. | |
| 2009/0256887 | A1 | 10/2009 | Inoue et al. | |
| 2010/0163517 | A1 | 7/2010 | Wang et al. | |

FOREIGN PATENT DOCUMENTS

| | | | |
|---|---|---|---|
| CN | 100389959 | | 5/2008 |
| EP | 638424 | A2 * | 2/1995 |
| JP | 2001341309 | | 12/2001 |
| KR | 20050122896 | | 12/2005 |

* cited by examiner

*Primary Examiner* — Lisa M Solomon
(74) *Attorney, Agent, or Firm* — Walter W. Karnstein

(57) ABSTRACT

A fluid ejection device includes a firing chamber having a chamber floor with an orifice opposite the chamber floor and a heating element partially covering the chamber floor, a region of the chamber floor being contoured to define a cavity extending into the chamber floor.

15 Claims, 7 Drawing Sheets

FLUID EJECTION DEVICE HAVING FIRING CHAMBER WITH CONTOURED FLOOR

BACKGROUND

One type of fluid ejection device is an inkjet-printing device. An inkjet printing device forms images on media by ejecting fluid such as ink though an orifice in fluid communication with a firing chamber. In some examples, droplets of fluid are thermally ejected from the inkjet-printing device using a heating resistor. When electrical power is applied to the heating resistor, resistance of the heating resistor causes the heating resistor to increase in temperature. This increase in temperature causes a bubble to be formed in the firing chamber, which results in ejection of a droplet of fluid through the orifice.

BRIEF DESCRIPTION OF THE DRAWINGS

The detailed description will make reference to the following drawings, in which like reference numerals may correspond to similar, though perhaps not identical, components. For the sake of brevity, reference numerals having a previously described function may or may not be described in connection with other drawings in which they appear.

DETAILED DESCRIPTION

When a fluid droplet is ejected from an orifice, most of the mass of the droplet is contained in the leading head of the droplet. The greatest velocity of the droplet is found in this mass. The remaining tail of the droplet contains a minority of the mass of fluid and has a distribution of velocity ranging from nearly the same as the droplet head at a location near the droplet head to a velocity less than the velocity of the fluid found in the droplet head and located closest to the orifice.

At some time during the transit of the droplet, the fluid in the tail is stretched to a point where the tail is broken off from the droplet. A portion of the fluid remaining in the tail is pulled back toward an orifice layer where it may form a puddle surrounding the orifice. Such puddles, if not controlled, may degrade the quality of printed material.

Some parts of the droplet tail are absorbed into the droplet head prior to the droplet being deposited upon the medium. However, other parts of the droplet tail may produce a fine spray of sub-droplets spreading in random directions. Some of this spray may reach the medium upon which printing occurs, thereby producing rough edges to the dots formed and potentially placing undesired spots on the medium (which may reduce clarity of the desired printed content). Such uncontrolled breaking of fluid tails also may cause misdirection of fluid droplets, and may disrupt firing chamber refill.

As noted above, an inkjet printing device may eject droplets of fluid onto media by applying electrical power to an ejection element, which ultimately results in the droplets of ink being ejected. A thermal inkjet printing device is a fluid ejection device that employs heating elements, typically resistors, to thermally eject fluid. Such resistors typically have been formed on the floor of the firing chamber, and have been in the shape of a rectangle. Uncontrolled breaking of fluid tails may cause returning fluid to impact the firing chamber floor with greater force, and thus may reduce resister life.

However, by altering the shape of the heating element, it is possible to contour the floor of the firing chamber so as to effect control over direction and breaking of fluid droplet tails. Although prior heating element designs generally have been constrained to covering the firing chamber floor, it is now possible to deviate from the basic solid plane rectangular design without experiencing the difficulties previously associated with more unconventional designs (e.g., concentration of electrical current, uneven heating, and long-term reliability issues).

Figure 1:
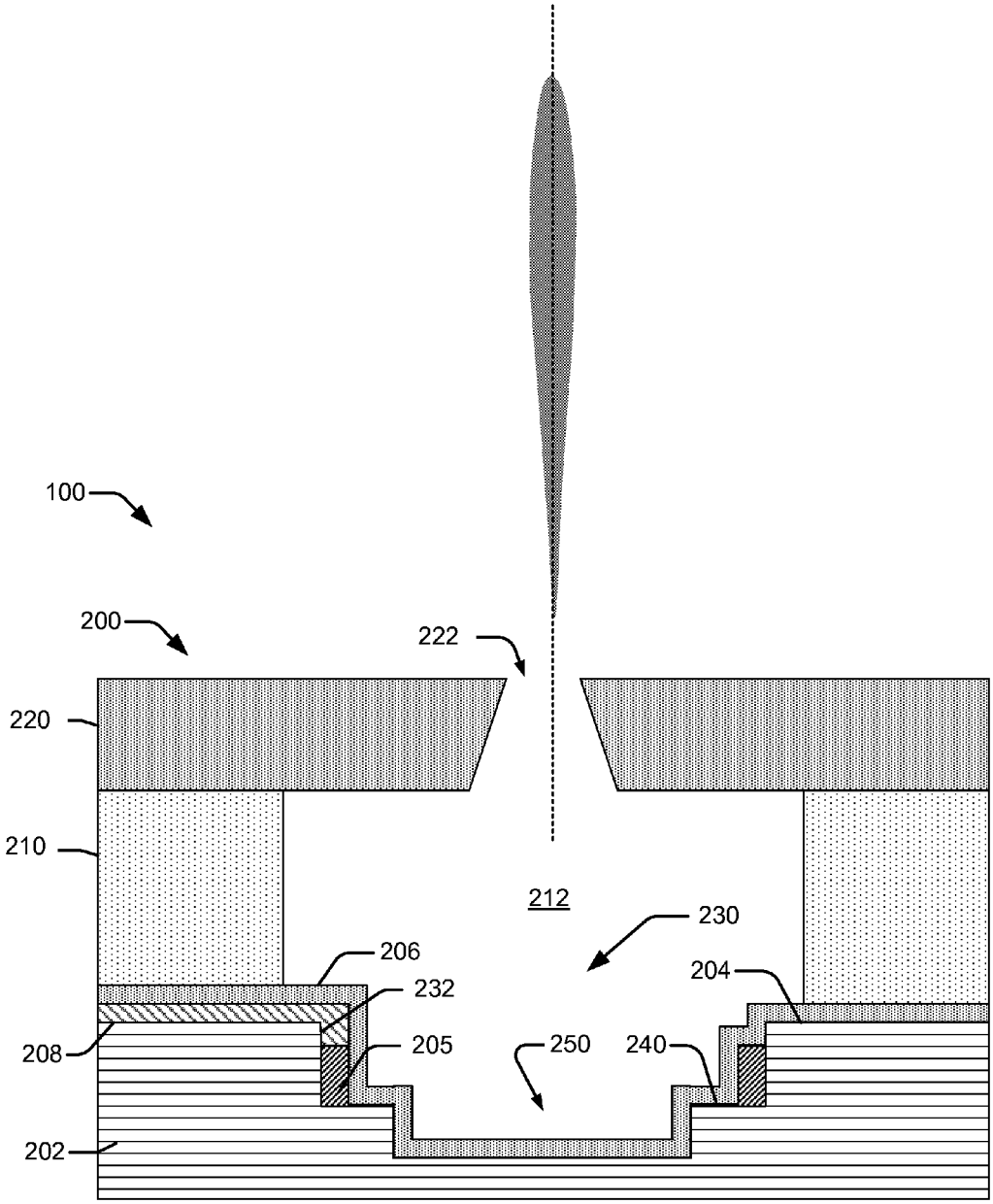
FIG. 1 is a partial cross-sectional view of an example printhead of a thermal ejection device, the printhead including a firing chamber with a cavity defined in the chamber floor according to an embodiment of the invention.

FIG. 1 shows a partial cross-sectional view of a printhead 200 forming a part of an example fluid ejection device 100. As shown, printhead 200 includes a substrate 202 made, for example, of Si with a dielectric layer such as SiO2. Substrate 202 has a surface 204 on which various elements and layers may be formed that make up printhead 200. As will become apparent, such elements and/or layers may be formed in various orientations with respect to surface 204, such as on top of surface 204, within surface 204, below the surface 204, and so on.

A heating element 205 may be formed on (or in) substrate 202, and may be covered by one or more overcoat layers 206 to provide structural stability and electrical insulation from fluid in the firing chamber. In some examples, heating element 205 is a resistive layer of tungsten silicon nitride (WSiN), for example, deposited on the surface of substrate 202, including over conductive electrodes 208. The heating element 205 may be deposited by conventional integrated circuit fabrication techniques such as sputtering a resistive material. There are several types of materials that may be used to make the heating element 205, such as a tantalum aluminum alloy, for example.

The heating element may be resistive in it is considered a resistor having greater resistance than that of a conductor such as that forming conductive electrodes 208. The resistance of the heating element 205 may be many times greater than the resistance of the conductive electrodes. As one example, this resistance ratio may be 5000 or higher.

A barrier layer/chamber layer 210 may be formed onto the substrate 202 as a dry film laminated by heat and pressure, for example, or as a wet film applied by spin coating. The chamber layer 210 material may be a photoimageable polymer such as SU8. A firing chamber 212 thus may be formed in chamber layer 210 by photoimaging techniques. A nozzle layer 220 may be formed on the chamber layer with a nozzle orifice 222 (also referred to as an ejection orifice) formed over firing chamber 212 such that nozzle orifice 222 and heating element 205 are aligned. Printhead 200 may include many such firing chambers, each with associated heating element (s) and nozzle orifice(s).

In some examples, a depression 230 may be formed in substrate 202 such that heating element 205 may be formed on a sidewall 232 or sidewalls (depending on depression shape) that extend around a perimeter of the depression. In such examples, the depression is formed within and below the surface of the substrate, and the heating element is formed within the substrate along the walls of the depression.

Because the heating element is not formed on the surface of substrate and does not make up a substantial part of the floor of the firing chamber, it is not as involved in the degradation process caused by the repeated collapse of vapor bubbles. This may reduce the need for an overcoat layer to protect the heating element, or at least may reduce the thickness of the overcoat layer employed to protect the firing chamber floor.

Furthermore, because the heating element is removed from a central region of the firing chamber floor 240, an uncovered region of the firing chamber floor may be contoured to effect control over direction and breaking of fluid droplet tails. As shown in FIG. 1, such contour may take the form of a cavity 250 that extends into the substrate, below the heating element. Cavity 250 may be concentrically aligned with nozzle orifice 222, as shown in FIG. 1, or may be positioned eccentric to the nozzle orifice. In some examples, position of the cavity is selected to compensate for discontinuities in firing chamber design.

Cavity shape, size and/or depth also may vary, depending on the desired effect on droplet ejection, firing chamber refill and/or chamber life (among other factors). Furthermore, in some examples, the firing chamber floor may define plural cavities and/or may define mesa within the cavity.

Figure 2:
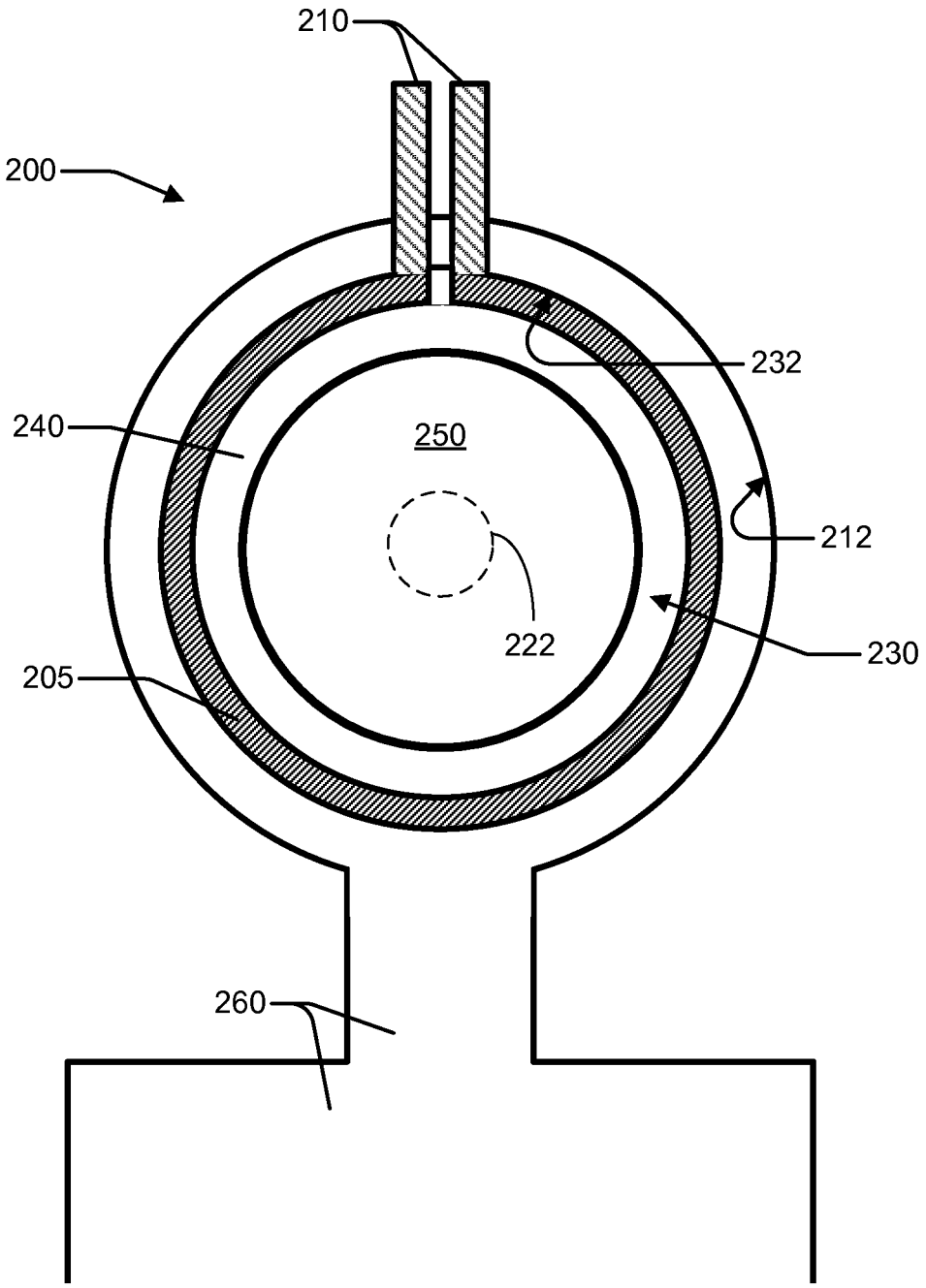
FIG. 2 is a partial top-down view of the example printhead of FIG. 1, the firing chamber having a circular recessed cavity in accordance with an embodiment of the invention

Referring now to FIG. 2, a simplified top-down view of example printhead 200 is shown (with overcoat layer 206 removed for clarity). As shown, the example printhead defines a circular firing chamber 212. Moreover, a circular depression 230 is formed in the floor of the substrate, the depression defining a sidewall 232 on which a ring-type heating element 205 is formed. A central region of chamber floor 240 thus is available for contour, and may be contoured to effect control over droplet shape, droplet tail break-off and firing chamber refill (though fluid inlet 260).

In the example shown in FIGS. 1 and 2, a circular cavity 250 is formed in chamber floor 240. Cavity 250 has a perimeter that is smaller than the perimeter of ring-type heating element 205, and may be centered on nozzle orifice 222 as shown to align fluid droplet tails with the nozzle orifice on tail break-off. It is believed that when the tail breaks off in the center of the orifice, it has less of a tendency to displace the straight-ahead trajectory of the main droplet. The cavity may extend below heating element 205 such that the cavity has a depth sufficient to influence the tail break-off from the fluid remaining in the firing chamber. The satellite droplets also thus may be directed to land in a substantially consistent location relative to the main droplet due to the fluidic effects of cavity 250.

In the example shown in FIGS. 1 and 2, cavity 250 is substantially cylindrically shaped. The shape of the cavity, however, is not so limited. The cavity may be elliptical, cubic, or virtually any other shape suitable to effect the desired control over system fluidics. Furthermore, it is to be understood that the size of the cavity 250 shown in relation to the printhead 200 is for purposes of illustration only, and is not intended to be a perfectly accurate or scaled representation.

Although heating element 205 is a resistor formed on the sidewall of a depression in the firing chamber floor, the heating element may take other forms, including a resistor (or resisters) formed on the firing chamber floor, or resistor suspended above the firing chamber floor. The form and position of the heating element may vary, provided the heating element does not entirely cover chamber floor 240.

Figure 3A:
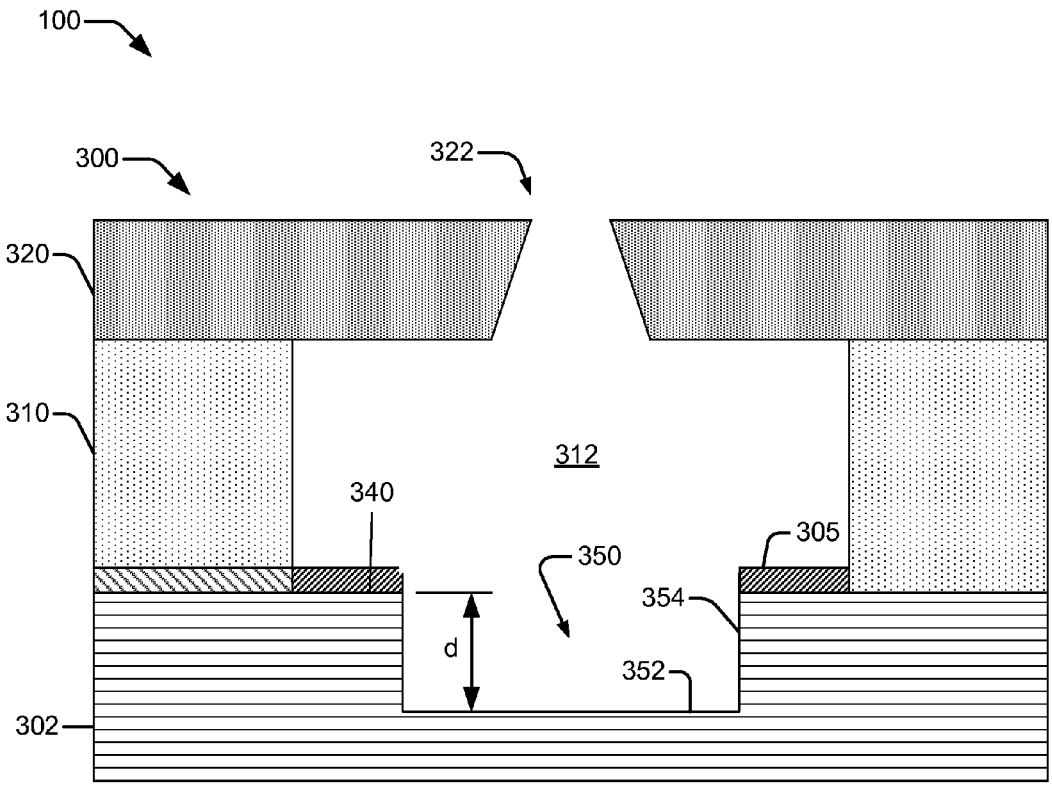
FIGS. 3A through 3C are partial cross-sectional views of example printheads employing ring-type resistors and contoured chamber floors within a perimeter of the resistors according to embodiments of the invention.

In FIG. 3A, fluid ejection device 100 is shown as including a printhead 300 with a ring-type heating resistor 305 formed on the floor 340 of a firing chamber 312. As in the example of FIGS. 1 and 2, the firing chamber is defined by a substrate 302, a barrier layer 310 and a nozzle layer 320. A nozzle orifice 322, in turn, is formed in the nozzle layer such that fluid may be ejected through the nozzle orifice upon activation of the heating resistor.

As used herein, "ring-type" heating element or heating resistor refers to a heating element or heating resistor that forms a pseudo-ring. Such heating element or heating resistor need not form a true ring insofar as a true ring has curved surfaces. Example ring-type heating restistors are shown in International Patent Application No. PCT/US11/23224 entitled "THERMAL FLUID-EJECTION MECHANISM HAVING HEATING RESISTOR ON CAVITY SIDEWALLS" and International Patent Application No. PCT/US1126732, entitled "RING-TYPE HEATING RESISTOR FOR THERMAL FLUID-EJECTION MECHANISM". The subject matter of those applications is incorporated herein by this reference thereto, Firing chamber floor 340 is contoured to define a cavity 350 that extends from ring-type heating resistor 305 in a direction opposite nozzle orifice 322. The shape, size and position of cavity 350 may be selected based on the desired impact on droplet ejection, firing chamber refill and/or chamber life (among other factors). In FIG. 3A, cavity 350 is substantially coextensive with an inner perimeter of ring-type heating resistor 305 and is centered on nozzle orifice 322. Cavity floor 352 may be planar, as shown, and may be at a depth (d) on the order of 5 micrometers. Cavity wall (or walls) 354 may extend vertically from cavity floor 352, as shown, or may extend, obliquely, acutely, or in some other fashion suitable for effecting the desired fluid control.

Although not particularly shown, firing chamber floor 340, heating resistor 305, cavity sidewall(s) 354 and/or cavity floor 352 may be covered by one or more overcoat layers to provide structural stability and electrical insulation from fluid in the firing chamber. Again, the printhead may include plural firing chambers 312, each with one or more associated heating resistor(s) and nozzle orifice(s).

Figure 3B:
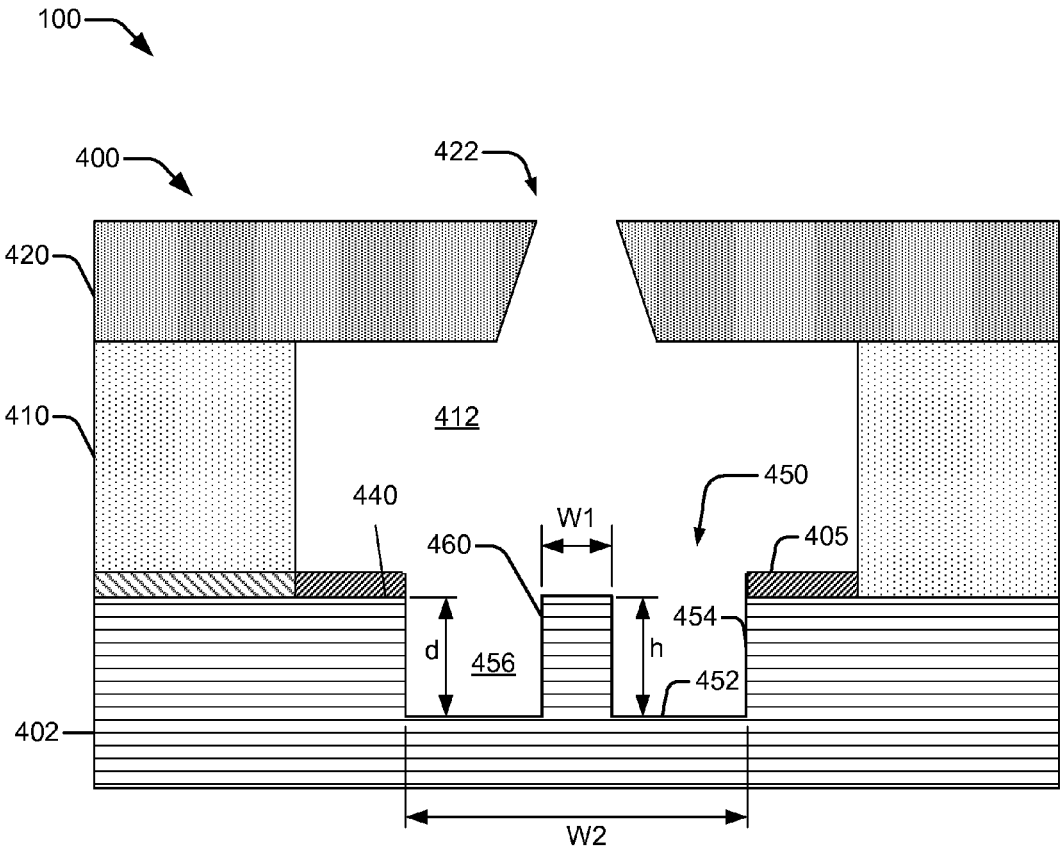

FIG. 3B shows a fluid ejection device 100 including a printhead 400 with a ring-type heating resistor 405 formed on the floor 440 of a firing chamber 412. Firing chamber 412 is defined by a substrate 402, a barrier layer 410 and a nozzle layer 420. A nozzle orifice 422 is defined in the nozzle layer such that fluid may be ejected through the nozzle orifice upon activation of the heating resistor.

In FIG. 3B, firing chamber floor 440 defines a cavity 450 that extends into substrate 402 opposite nozzle orifice 422. Again, the shape, size and position of cavity 450 may be selected based on the desired impact on droplet ejection, firing chamber refill and/or chamber life (among other factors). Cavity 450 is formed in an interior region of chamber floor 440 within a perimeter defined by ring-type heating resistor 405.

As indicated, cavity 450 is defined by a cavity floor 452 and a cavity sidewall (or sidewalls) 454, and further includes a mesa 460 projecting from the cavity floor. In the present example, both cavity 450 and mesa 460 are centered on nozzle orifice 422, but the mesa and/or cavity may be offset from the nozzle orifice as desired in view of characteristics of the printhead and/or fluid to be ejected. Cavity 450 may be cylindrical, but may take other forms. Similarly, mesa 460 may be cylindrical, but may take other forms. Mesa 460 may or may not match the profile of cavity 450.

Mesa 460 nominally has a mesa width (W1) that is less than the cavity width (W2), thereby providing a well 456 that surrounds the mesa. This well may be configured to receive and dampen forces impingent on the chamber floor upon tail break-off and/or bubble collapse. This, in turn, may allow for reduction (or even elimination) of the overcoat layer(s) described in connection with the example of FIGS. 1 and 2.

FIG. 3B depicts mesa 460 with a height (h) corresponding to cavity depth (d). However, in some examples, mesa height (h) may be less than cavity depth (d). In other examples, mesa height (h) may be greater than cavity depth (d), but the mesa will not project so far as to reach nozzle orifice 422. In the particular example shown, cavity depth and mesa height are on the order of 5 micrometers.

Figure 3C:
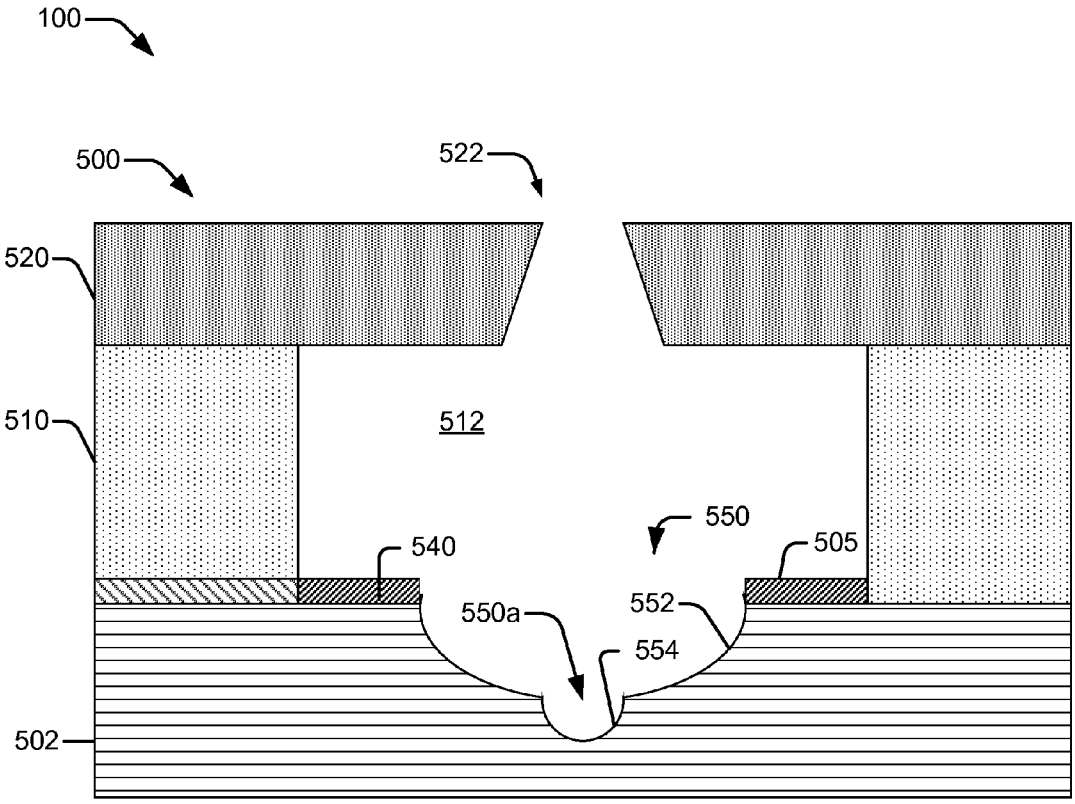

FIG. 3C shows a fluid ejection device 100 including a printhead 500 with a ring-type heating resistor 505 formed on the floor 540 of a firing chamber 512. Firing chamber 512 is defined by a substrate 502, a barrier layer 510 and a nozzle layer 520. A nozzle orifice 522 is defined in the nozzle layer such that fluid may be ejected through the nozzle orifice upon activation of the heating resistor. Again, the printhead may include plural firing chambers, each with one or more associated heating resistor(s) and nozzle orifice(s).

Firing chamber floor 540 may be contoured to define a cavity 550 in chamber floor 540. In FIG. 3C, the example cavity 550 is defined by a first semi-spherical surface 552 and a second semi-spherical surface 554. Cavity 550 may be characterized as a compound cavity, semi-spherical surface 554 effectively forming a sub-cavity 550*a* within semi-spherical surface 552. As indicated, both cavity 550 and sub-cavity 550*a* may be centered on nozzle orifice 522. However, the particular shape, size and position of cavity 550, and or sub-cavity 550*a* may vary. In some examples, sub-cavity 550*a* may be employed to tune the effect of cavity 550 on droplet shape, droplet tail break-off and/or firing chamber refill.

Figure 4A:
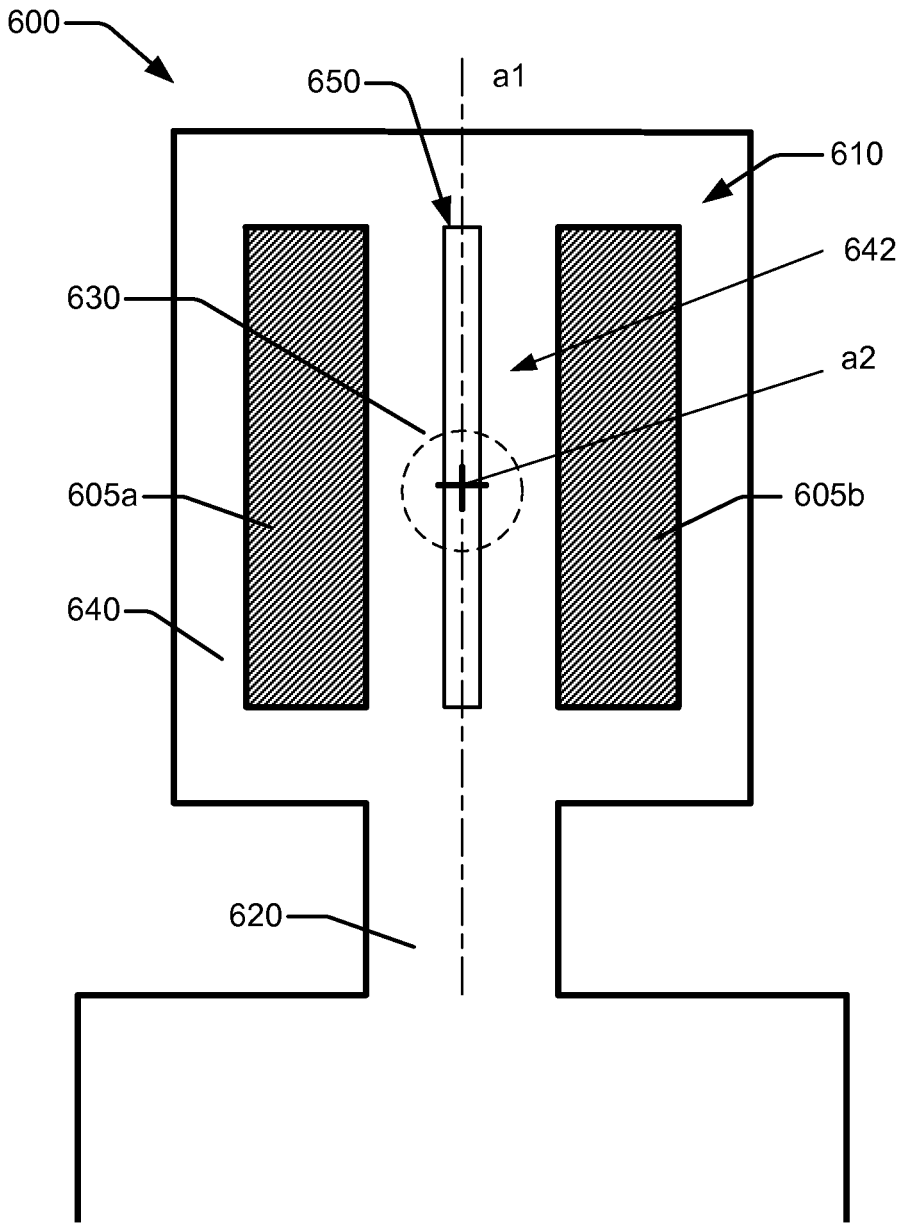
FIGS. 4A and 4B are partial top-down views of example printheads having firing chambers with elongate cavities formed in the firing chamber floors according to embodiments of the invention.

In FIG. 4A, a simplified top-down view of example printhead 600 forming a part of a fluid ejection device is shown, the printhead defining an elongate firing chamber 610 fed by a fluid inlet 620. A nozzle orifice 630 is shown in dashed line to indicate that the nozzle is above the plane of the firing chamber.

As indicated, the example firing chamber includes a heating element with a plurality of heating element segments 605*a* and 605*b* on the firing chamber floor 640. Although two segments are shown, the heating element may include more than two heating element segments. The heating element segments may be similarly spaced on opposite sides of the firing chamber relative the nozzle orifice to minimize discontinuities in fluid droplet ejection and/or tail break-off due to, among other things, the shape of the firing chamber. Although a rectangular firing chamber and rectangular resistors are depicted, the firing chamber and heating element segments may take various other forms.

A central region 642 of chamber floor 640 may be defined between the heating element segments 605*a* and 605*b*. As shown, an elongate cavity 650 may be provided in the central region of the chamber floor. Cavity 650 may be a rectangular cavity, as shown, and may define a major axis a1 that extends across the chamber floor. In the depicted example, major axis a1 corresponds to the direction of fluid feed through fluid inlet 620. Furthermore, in the depicted example, major axis a1 of cavity 650 bisects nozzle orifice axis a2. However, the shape, size, position and orientation of cavity 650 may be selected based on the desired impact on droplet ejection, firing chamber refill and/or chamber life (among other factors).

Figure 4B:
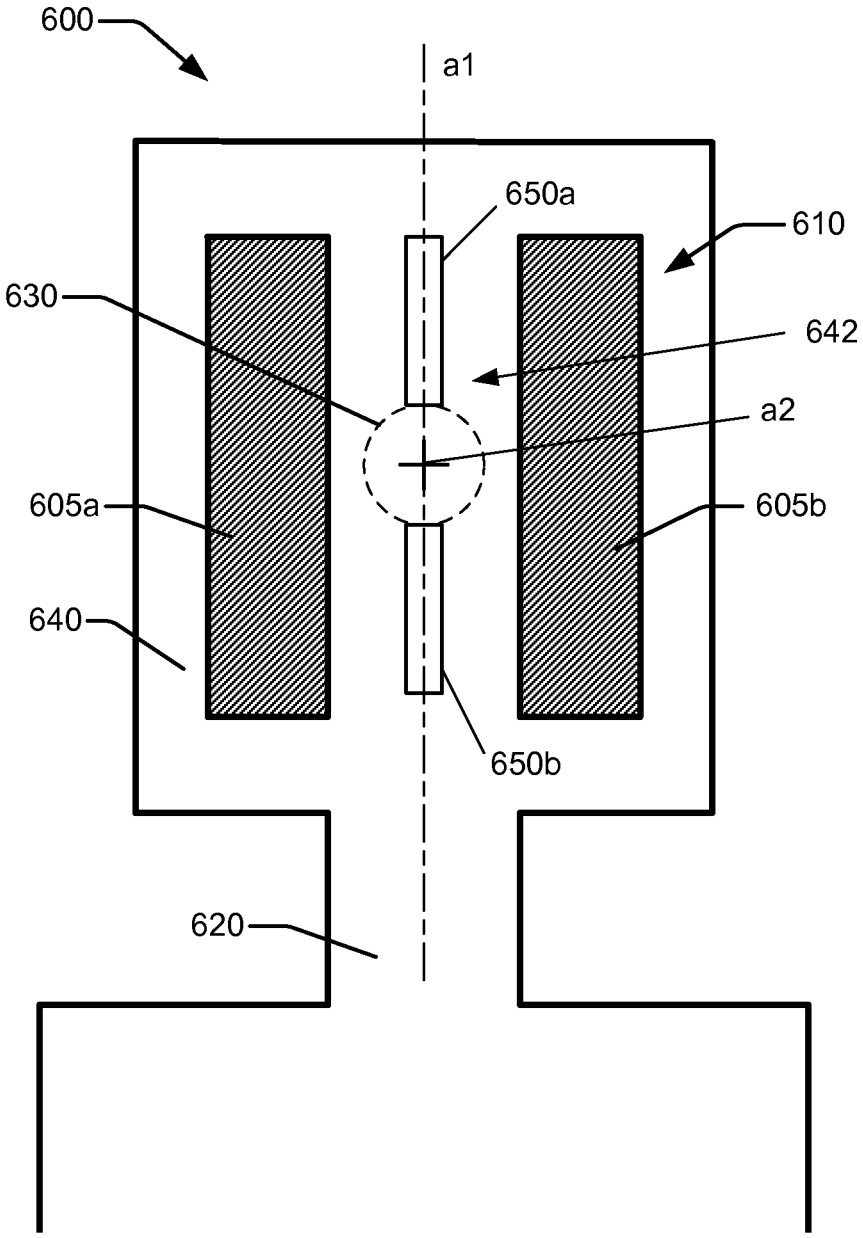

Although the length of cavity 650 is shown as corresponding to the length of heating element segments 605*a* and 605*b*, the cavity length (and cavity width) are not limited in this way. FIG. 4*b*, for example, shows a printhead 600 with a pair of spaced cavities 650*a* and 650*b* extending along axis a1. Three or more spaced cavities also are contemplated.

In operation, fluid ejection devices such as those described herein effect droplet ejection by activation of a heating element (or heating elements) under direction of a controller. The controller may be implemented in hardware, or a combination of machine-readable instructions and hardware, and controls ejection of drops of fluid from the fluid ejection device in a desired manner by the heating elements.

It is noted that the concepts described herein may be implemented in an inkjet printing device, such as a printer, that ejects ink onto media to form images on the media. However, the concepts more generally apply to fluid ejection devices, which may include precision-dispensing device that precisely dispense fluids such as ink, melted wax, or polymers.

We claim:

1. A fluid ejection device comprising:

a firing chamber having a chamber floor and an orifice opposite the chamber floor; and a heating element partially covering the chamber floor to define an uncovered region of the chamber floor;

wherein the uncovered region of the chamber floor is contoured to define a cavity extending into the chamber floor.

2. The fluid ejection device of claim 1, wherein the heating element is a ring-type heating element having an inner perimeter that defines the uncovered region of the chamber floor.

3. The fluid ejection device of claim 2, wherein the cavity perimeter is coextensive with the inner perimeter of the ring-type heating element.

4. The fluid ejection device of claim 2, wherein the cavity has a perimeter that is smaller than the inner perimeter of the ring-type heating element.

5. The fluid ejection device of claim 2, wherein the cavity is centered on the orifice.

6. The fluid ejection device of claim 1, wherein the cavity includes a cavity floor and a mesa projecting from the cavity floor, thereby defining a well surrounding the mesa.

7. The fluid ejection device of claim 6, wherein the cavity and mesa are centered on the orifice.

8. The fluid ejection device of claim 1, wherein the cavity is a compound cavity, defining a sub-cavity formed in the cavity.

9. The fluid ejection device of claim 1, wherein the cavity is an elongate cavity defining a major axis extending across the chamber floor.

10. The fluid ejection device of claim 9, wherein the heating element includes a plurality of spaced heating element segments defining a central region on the chamber floor, and wherein the elongate cavity is in the central region.

11. The fluid ejection device of claim 1, wherein the uncovered region of the chamber floor is contoured to define plural cavities in the chamber floor.

12. A fluid ejection device comprising:

a firing chamber having a fluid inlet, an ejection orifice and a chamber floor opposite the ejection orifice, the chamber floor having a central region with a cavity formed therein; and a heating element within the firing chamber, the heating element extending around the cavity.

13. The fluid ejection device of claim 12, wherein the cavity is cylindrical.

14. The fluid ejection device of claim 12, wherein the heating element is a ring-type resistor on the chamber floor.

15. A fluid ejection device comprising:

a firing chamber having a chamber floor, one or more walls and a nozzle layer with an orifice opposite the chamber floor;

a ring-type heating element on the chamber floor, the heating element defining an inner perimeter; and a cavity defined in the chamber floor, the cavity being coextensive with the inner perimeter.

* * * * *